United States Patent [19]

Schmetz et al.

[11] Patent Number: 4,691,825

[45] Date of Patent: Sep. 8, 1987

[54] NEEDLE PACKAGE

[75] Inventors: Peter-Nikolaus Schmetz, Herzogenrath; Peter Klöcker, Würselen, both of Fed. Rep. of Germany

[73] Assignee: Firma Ferdinand Bernhard Schmetz, Herzogenrath, Fed. Rep. of Germany

[21] Appl. No.: 670,745

[22] Filed: Nov. 13, 1984

[51] Int. Cl.[4] ..... B65D 85/24

[52] U.S. Cl. ..... 206/380; 206/443; 206/560

[58] Field of Search ..... 206/380, 214, 337, 443, 206/477, 480, 560

[56] References Cited

U.S. PATENT DOCUMENTS

| | | | |
|---|---|---|---|
| 3,384,220 | 5/1968 | Linstead | 206/380 |
| 4,136,623 | 1/1979 | Thyen | 206/380 |
| 4,186,073 | 1/1980 | Paganoni | 206/380 |

*Primary Examiner*—Joseph Man-Fu Moy

*Attorney, Agent, or Firm*—Toren, McGeady, Stanger, Goldberg & Kiel

[57] ABSTRACT

A needle package from a panel with needle pockets adjacent to each other and clamping webs protruding into the pockets comprising a withdrawal cavity extending transversely to the pockets and slit pocket walls in the area of the clamping webs.

7 Claims, 7 Drawing Figures

Figure 5:
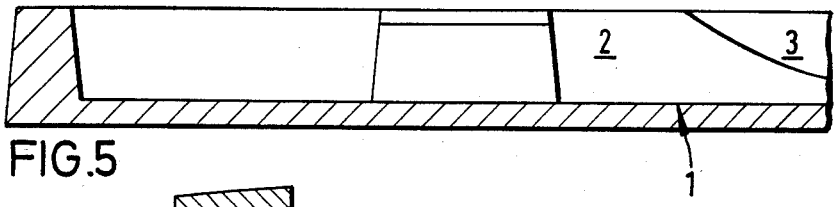

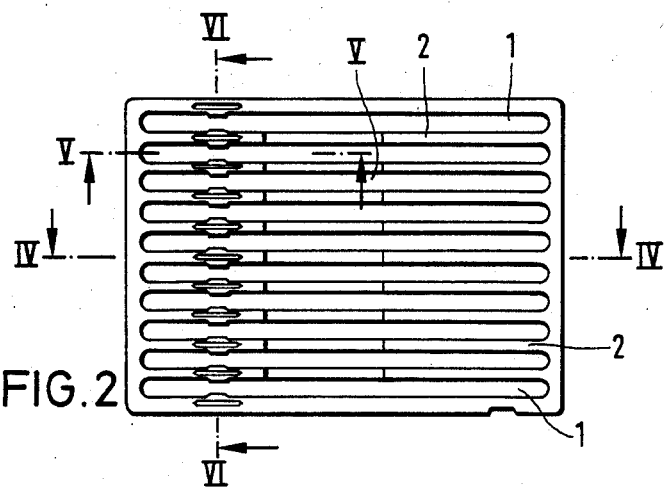
FIG. 2
FIG. 4
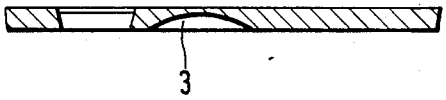
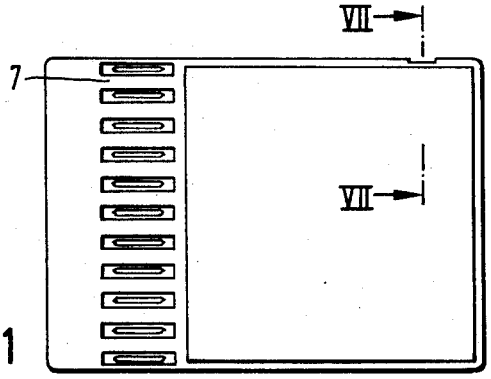
FIG. 1
FIG. 3
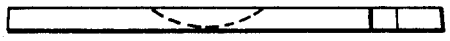

NEEDLE PACKAGE

The invention is directed to a needle package from a panel with needle pockets lying adjacent to each other and clamping webs protruding into said pockets.

Packages of the just-mentioned sort are known; thus the German Utility Model document No. 76 23 264 describes a package suitable also for needles made from a base plate equipped with intermediate walls. The intermediate walls comprise clamping webs, with the help of which the packaged products are retained in between the walls. The base plate has a window extending transversely to the pin-like packaged products. This window permits the pressing-up and out of the packaged products retained between the walls and the clamping webs with the help of one finger.

A package for pin-like packaged products known from the German patent document No. 1 037 956 and the German Utility Model document No. 78 08 823 differs from the previously mentioned package in that the opening in the area of the detent projections extends transversely over the intermediate walls. Hereby the opening is dimensioned in such a way that the user can with one finger push through and partly lift the packaged products or is able to press the packaged products out in between the sprung-elastic intermediate walls and the detent projections, without being hindered in this by the intermediate walls which overlap the opening.

All the known packages comprise an opening corresponding to the usual finger sizes of an adult, which in the case of a needle package is located in the area of the butts. Therefore, the butts are more or less unprotected in the area of the opening and additionally not supported from the bottom side. Since, moreover, the needles lie comparatively close to each other, the pressing out of several needles, as a function of finger size, is frequently unavoidable. Additionally, a withdrawal equitable with the utilization is impossible. Furthermore, the longitudinal stability of the package suffers by the comparatively large openings. This is fraught with disadvantages when bending the package cannot be avoided in actual use, since namely then the butts of the flexurally stiff needles involuntarily slide by the detent projections and the needles jump out of the package. The normal withdrawal of a needle results also in difficulties, since the needle pressed out from its retention must be caught in the hollow palm of the hand holding the package, which can result in injuries.

The invention is therefore based on the task to create a package particularly suitable for needles, which supports and protects the packaged products from the bottom side as well as assuring a safe retention of the needles in their pockets also in utilizing a comparatively elastic material and simultaneously permitting a handy withdrawal of single needles adaptively to their utilization from the side of the package facing away from the bottom.

The solution of this task consists in that, in a package of the previously mentioned sort, a withdrawal cavity extends transversely to the pockets for the packaged products, which allows an effortless gripping and lifting out of the packaged products from the front side of the package. This withdrawal cavity is in effect created by at least partial elimination of the pocket sidewalls in the direction of the package bottom so that above the here-continuous panel bottom a trough-shaped recess is formed.

This recess permits to singly grip the needles, inserted in the pockets and tightly clamped at their butts between the clamping webs and the package bottom, and leverage them out of their pockets. Hereby the danger of losing the needle concerned does not exist, since it can be gripped, after leveraging from its pocket, simultaneously between the finger concerned and the opposite thumb. The withdrawal cavity located in the front side of the package makes the withdrawal of the needle with one hand possible, contrary to the packages having a withdrawal opening in the panel bottom. In this case the package merely has to lie on a support, in order to slightly lift and withdraw the needle in the previously described way.

The danger, that—as is the case with the known packages—more than one needle at the same time can be released from its retention, does not exist in the package according to the invention, insofar as the two fingers, which leverage or grip the needle to be withdrawn, necessarily are supported on the front side of the package and thus push back the in each case adjacent needles into their pockets.

In order to be able to utilize a standardized package for the whole spectrum of the greatly differing butt diameters, the pocket sidewalls can be slit in the area of the retaining lugs, in order to, in this way, create a free space for the clamping webs pressed sidewise, meaning transversely to the butt's longitudinal axis, by the larger butts, but, at the same time, to also ensure a safe retention of the needles in the package. This is particularly the case, if the sidewall portions bounding the slits of the free space are pre-arched with the clamping webs in direction of the needle pockets and accordingly behave like a leaf spring.

In order to improve the retainability, the clamping webs run preferentially in the pocket longitudinal direction; they lean against the needle butts, with their axes parallel thereto, and press these against the package—or pocket bottom. The clamping webs can be arranged in the area of a transverse opening, which, however, need no longer be sized corresponding to the dimensions of the finger of an adult. Preferably however the pocket sidewalls overlap in each case one bottom opening in the area of the slits or clamping webs, in order to clamp the needle butts, without impairment of the longitudinal stability, in this way, as it were, in an elastically-sprung lining of in each case two retaining webs or lugs and the bottom bars, which result in each case between the two bottom openings associated with the clamping webs. The clamping ability of this lining can be further improved by opposite clamping webs in their original position extending in a V-shaped fashion, however with clamped needle butts in them in a reversed V-shaped fashion. Such a change of position of the clamping webs is, in view of the corresponding slits in the pocket sidewalls, possible without any difficulties.

Figure 6:
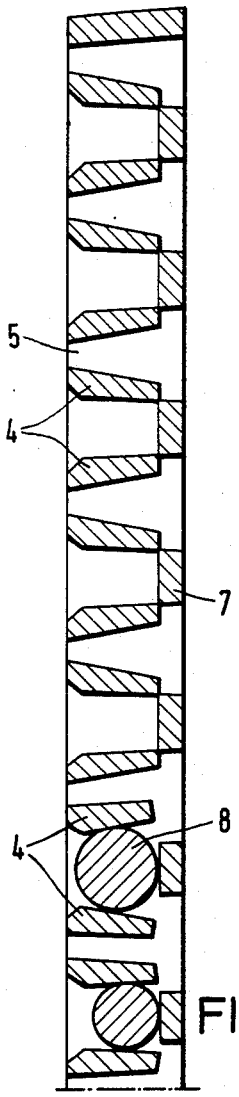
Figure 7:
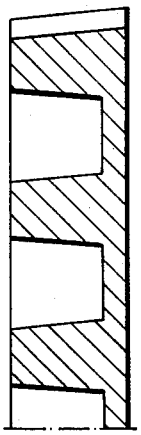

In the following the invention is explained with the help of a drawing depicting an embodiment example in further detail. The drawing shows:

FIG. 1 the bottom view of a needle package according to the invention,

FIG. 2 a front view of the package in FIG. 1,

FIG. 3 a side view of the package in FIG. 1,

FIG. 4 a section through the package along a line IV—IV in FIG. 2,

FIG. 5 a section through a needle pocket along the the line V—V in FIG. 2, FIG. 6 a section through the package along the line VI—VI in FIG. 2, and FIG. 7 a section through several needle pockets along a line VII—VII in FIG. 1.

The package in the invention comprises several needle pockets 1 adjacent to each other with sidewalls 2. A withdrawal cavity 3 extends transversely to the sidewalls 2 in about the middle area of the package, meaning an area in which the pocket sidewalls 2 are recessed in the shape of a circular arc. The pocket side walls comprise, beyond the withdrawal cavity on both sides in each case, one clamping web 4 and between each two clamping webs a longitudinal slit 5, below which in each case an opening 6 is located in the package bottom. Accordingly, a bottom bar 7 extends between each two openings 6, which in its empty state together with the clamping webs 4 forms in its cross-section a slightly V-shaped needle pocket closed on three sides. When a needle is inserted the needle stem 8 presses the clamping webs 4 outwardly in a reverse V-shaped fashion, so that these, as it were, pivot into the longitudinal slit or the free space 5 and finally together with the bottom bar fix the butt in such a way, that dropping out is no longer possible.

The withdrawal cavity 3 located below the clamping webs 4 in direction of the needle tip, allows to grip the individual needle shaft with the nail of one finger, in order then to pivot it slightly around the top around a fulcrum located approximately at the free end of the needle butt and finally to grip it with the opposite thumb. Hereby the needle stem glides past the spreading clamping webs, until it is finally freed and the needle is ready for use.

Thus altogether a needle package results which is suitable for other pin-like packaged products, which assures an easy packing and withdrawal of the needles and at the same time optimally protects these from the bottom side.

We claim:

1. Needle package formed of a plate-like panel having a front side and a back side, said panel having a plurality of elongated side-by-side needle pockets recessed inwardly from the front side of said panel and closed by the back side of said panel, said panel forming a plurality of side walls extending from the front side toward the back side of said panel and forming oppositely elongated side walls of said needle pockets, a removal cavity extending transversely of the elongated direction of said needle pockets, wherein the improvement comprises that said needle pockets have opposite ends spaced apart in the elongated direction thereof, each of said side walls having a clamping web extending into said needle pocket for holding a needle between said clamping webs on the opposite side of each said needle pocket, a bottom bar located in the back side of said plate-like panel for each said needle pocket and extending between said clamping webs of the associated said needle pocket, and said clamping webs being displaceable outwardly away from one another and relative to said bottom bar when a needle is inserted into said needle pocket.

2. Needle package according to claim 1 characterized in that, the pocket side walls (2) are slit in the region of the clamping webs (4).

3. Needle package according to claim 2, characterized in that, the slits (5) separate the clamping webs (4) of adjacent said needle pockets, and said clamping webs are pre-arched inwardly into the needle pockets (1).

4. Needle package according to claims 1, 2 or 3, characterized in that, the clamping webs (4) and slits extend in the elongated direction of the pockets.

5. Needle package according to claim 1, wherein said clamping webs have a generally V-shaped cross-section extending transversely of the elongated direction of said needle pockets with said clamping webs converging slightly inwardly toward one another from the front side toward the back side of said plate-like panel.

6. Needle package according to claim 1, wherein said removal cavity is located in the front side of said plate-like panel and is spaced from the back side.

7. Needle package according to claim 3, wherein an opening is provided in the back side of said plate-like panel between each pair of adjacent bottom bars with said opening extending in the elongated direction of said needle pockets and being aligned opposite said slits separating said clamping webs.

* * * * *